US008818239B2

(12) United States Patent
Yamamoto et al.

(10) Patent No.: US 8,818,239 B2
(45) Date of Patent: Aug. 26, 2014

(54) IMAGE FORMING APPARATUS HAVING TRANSFER BELT CONTROL

(75) Inventors: Shinji Yamamoto, Kawasaki (JP); Yasumi Yoshida, Yokohama (JP); Tadashi Matsumoto, Tokyo (JP); Takashi Hiratsuka, Kawasaki (JP); Toshihiro Fukasaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 200 days.

(21) Appl. No.: 13/312,136

(22) Filed: Dec. 6, 2011

(65) Prior Publication Data

US 2012/0148299 A1 Jun. 14, 2012

(30) Foreign Application Priority Data

Dec. 9, 2010 (JP) ..... 2010-274210

(51) Int. Cl.
*G03G 15/00* (2006.01)
*G03G 15/01* (2006.01)
*G03G 15/08* (2006.01)

(52) U.S. Cl.
USPC ..... 399/121; 399/165; 399/302

(58) Field of Classification Search
USPC ..... 399/121, 165, 302
See application file for complete search history.

(56) References Cited

U.S. PATENT DOCUMENTS 6,321,052 B1 * 11/2001 Yamashina et al. ..... 399/165
6,871,036 B2 * 3/2005 Asuwa et al. ..... 399/302
7,551,881 B2 * 6/2009 Iinuma ..... 399/302
7,751,764 B2 * 7/2010 Iinuma ..... 399/303
8,064,810 B2 11/2011 Okumura et al.
2006/0289280 A1 * 12/2006 Furuya et al. ..... 198/806
2009/0123197 A1 * 5/2009 Okumura et al. ..... 399/301
2009/0162098 A1 * 6/2009 Shirakata ..... 399/165
2010/0189475 A1 * 7/2010 Atwood et al. ..... 399/302
2011/0200343 A1 8/2011 Matsumoto et al.
2011/0217090 A1 9/2011 Yamamoto et al.
2012/0213559 A1 * 8/2012 Krucinski ..... 399/302

FOREIGN PATENT DOCUMENTS

JP 2000-233843 A 8/2000
JP 2006-76784 A 3/2006

* cited by examiner

*Primary Examiner* — Walter Lindsay
*Assistant Examiner* — David Bolduc
(74) *Attorney, Agent, or Firm* — Fitzpatrick, Cella, Harper & Scinto

(57) ABSTRACT

An apparatus includes a belt member, a first image bearing member, a second image bearing member provided downstream of the first image bearing member, and a first steering roller provided upstream of the first image bearing member for controlling a widthwise position of the belt member by inclining at a position. In addition, a second steering roller is provided downstream of the second image bearing member and controls the widthwise position of the belt member, a first detecting member detects a widthwise position of the belt member on the first image bearing member, and a second detecting member detects a widthwise position of the belt member on the second image bearing member. A first control portion controls an inclination of the first steering roller on the basis of a detection result of the first detecting member, and a second control portion controls the second steering roller on the basis of a detection result of the first detecting member before a predetermined time and a current detection result of the second detecting member.

6 Claims, 19 Drawing Sheets

IMAGE FORMING APPARATUS HAVING TRANSFER BELT CONTROL

FIELD OF THE INVENTION AND RELATED ART

The present invention relates to an image forming apparatus in which lateral movement (deviation) correction control of a belt member is effected at upstream and downstream sides of a transfer surface on which a plurality of image bearing members are provided. Specifically, the present invention relates to control for alleviating an error of superposition of toner images transferred after widthwise positional deviation of the belt member with respect to an upstream image bearing member.

Such an image forming apparatus that a plurality of image bearing members are provided on a transfer surface of the belt member (intermediary transfer belt or recording material conveyer belt) supported by a plurality of rotatable supporting members and then toner images of respective colors are superposed on the belt member (or a recording material on the belt member) has been widely used. In the image forming apparatus using the belt member, when the belt member is moved in a widthwise direction, i.e., a longitudinal direction of the rotatable supporting member, a superposition error of the plurality of toner images occurs.

For this reason, in general, one of the rotatable supporting members is replaced with a steering roller, and a rotational position of the belt member is dynamically controlled by tilting the steering roller depending on a detected movement state (lateral movement amount) of the belt member.

However, in the case of the single steering roller, the lateral movement amount at a position in which the belt member is supported by the steering roller (or at a detection position of the lateral movement amount) can be corrected but tilting (skew) of the transfer surface with respect to the rotational direction cannot be corrected. The tilting of the transfer surface causes the toner image on the downstream image bearing member to be transferred onto a position deviated, with respect to the widthwise direction of the belt member, from a position in which the toner image transferred from the upstream image bearing member, thus resulting in an occurrence of positional deviation of the toner images.

For this reason, an image forming apparatus in which the steering roller is provided at each of upstream and downstream sides of the transfer surface, and the lateral movement amount is corrected at each of the upstream and downstream sides of the transfer surface to keep the tilting of the transfer surface at a constant level has been put into practical use (Japanese Laid-Open Patent Application (JP-A) 2000-233843 and JP-A 2006-076784).

In JP-A 2000-233843, the steering roller is provided downstream of the transfer surface of the intermediary transfer belt and is tilted so that the lateral movement amount detected at the downstream side of the transfer surface is corrected. Then, a secondary toner belt is tilted so as to correct a difference in detected lateral movement amount between the transfer surface downstream side and the transfer surface upstream side, so that the tilting (skew) of the transfer surface is eliminated.

In JP-A 2006-076784, the image forming apparatus in which the steering roller is provided at each of upstream and downstream sides of the transfer surface on which four image bearing members are provided, and a difference in detected lateral movement amount between the transfer surface downstream side and the transfer surface upstream side is corrected is described.

In the image forming apparatus described in JP-A 2000-233843, depending on timing of entering of the recording material into a secondary transfer portion or the like, the lateral movement in the widthwise direction occurs with irregular timing at the upstream side of the transfer surface of the belt member. When the lateral movement occurs at the upstream side of the transfer surface of the belt member, at the moment, the toner image on the upstream image bearing member is transferred onto a position deviated in the widthwise direction of the belt member. Thereafter, by lateral movement correction control, the lateral movement amount of the belt member and the tilting of the transfer surface are corrected.

However, the toner image transferred from the upstream image bearing member is conveyed to a position of the downstream image bearing member without changing its widthwise position on the belt member, so that the toner image on the downstream image bearing member is superposedly transferred onto the transferred toner image. For this reason, when the correction of the lateral movement of the belt member and the tilting of the transfer surface is completed at the time when the toner image on the belt member reaches the position of the downstream image bearing member, widthwise positional deviation occurs between the toner image transferred from the downstream image bearing member and the toner image transferred from the upstream image bearing member.

Also in the image forming apparatus described in JP-A 2006-076784, a similar phenomenon occurs. That is, when the toner image is transferred from the downstream image bearing member at a proper widthwise position onto the toner image transferred from the upstream image bearing member in a positional deviation manner, the position deviation occurs between the two toner images.

SUMMARY OF THE INVENTION

A principal object of the present invention is to provide an image forming apparatus capable of reducing an error of superposition of a toner image, transferred from a downstream image bearing member, on a toner image transferred from an upstream image bearing member when lateral movement is generated at an upstream side of a transfer surface.

According to an aspect of the present invention, there is provided an image forming apparatus comprising: a belt member; a first image bearing member for bearing a toner image to be transferred onto the belt member; a second image bearing member, provided downstream of the first image bearing member with respect to a rotational direction of the belt member, for bearing a toner image to be transferred onto the belt member; first steering means, provided upstream of the first image bearing member with respect to the rotational direction of the belt member, for controlling a widthwise position of the belt member so that the toner image formed on the first image bearing member is transferred onto the belt member at a predetermined widthwise position of the belt member; and second steering means, provided downstream of the second image bearing member with respect to the rotational direction of the belt member, for controlling the widthwise position of the belt member so that lateral movement of the belt member on the second image bearing member is, when lateral movement of the belt member on the first image bearing member in the widthwise direction of the belt member is generated, generated in the same direction as that of the lateral movement of the belt member on the first image bearing member with a delay of a movement time of the belt member from the first image bearing member to the second image bearing member.

These and other objects, features and advantages of the present invention will become more apparent upon a consideration of the following description of the preferred embodiments of the present invention taken in conjunction with the accompanying drawings.

Figure 6:
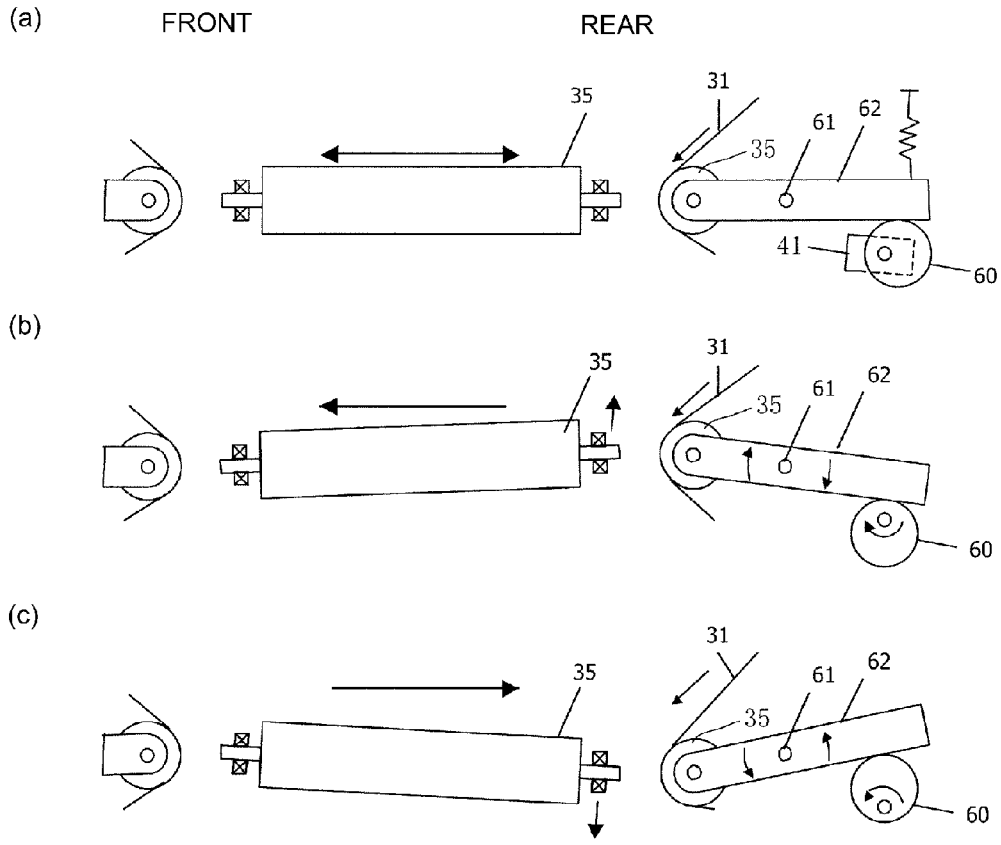

Parts (a) to (c) of FIG. 6 are illustrations of a steering mechanism.

Figure 7:
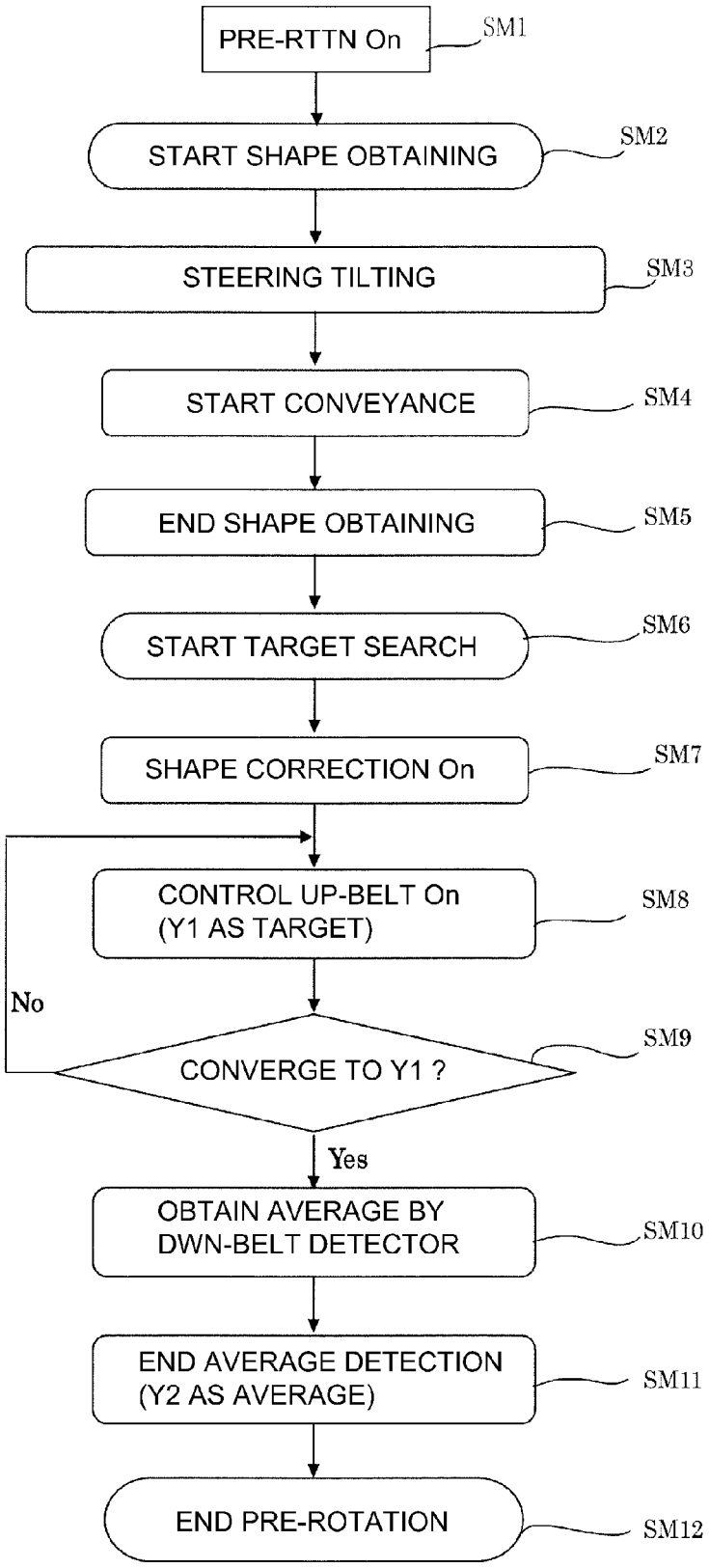

FIG. 7 is a flow chart of a pre-rotation operation of the intermediary transfer belt before image formation.

Figure 8:
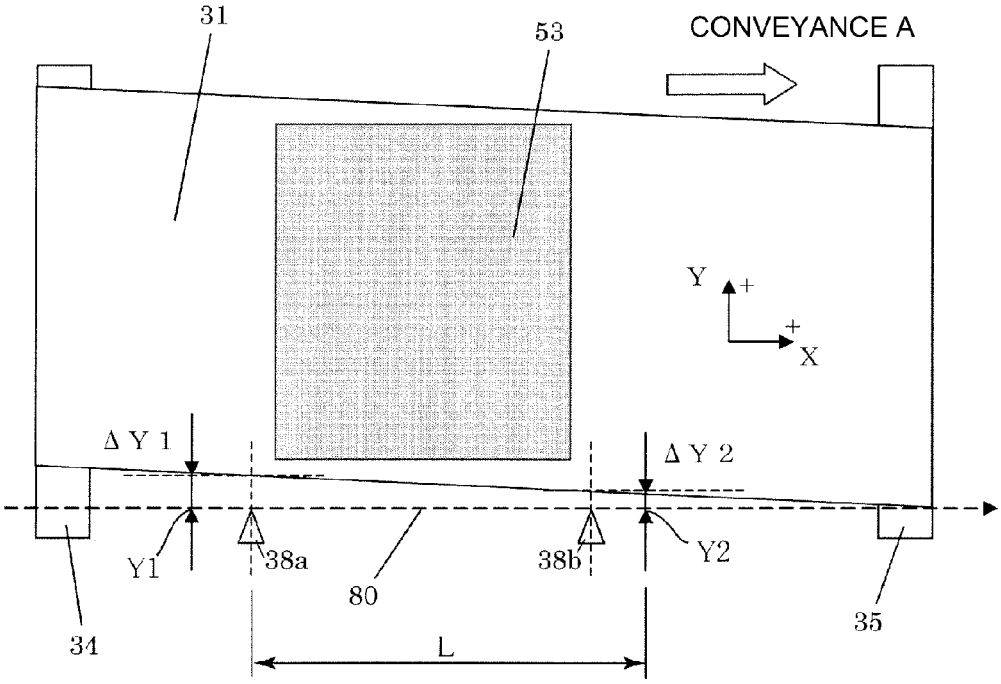

FIG. 8 is an illustration of tilting of the intermediary transfer belt detected by the belt edge sensors.

Figure 9:
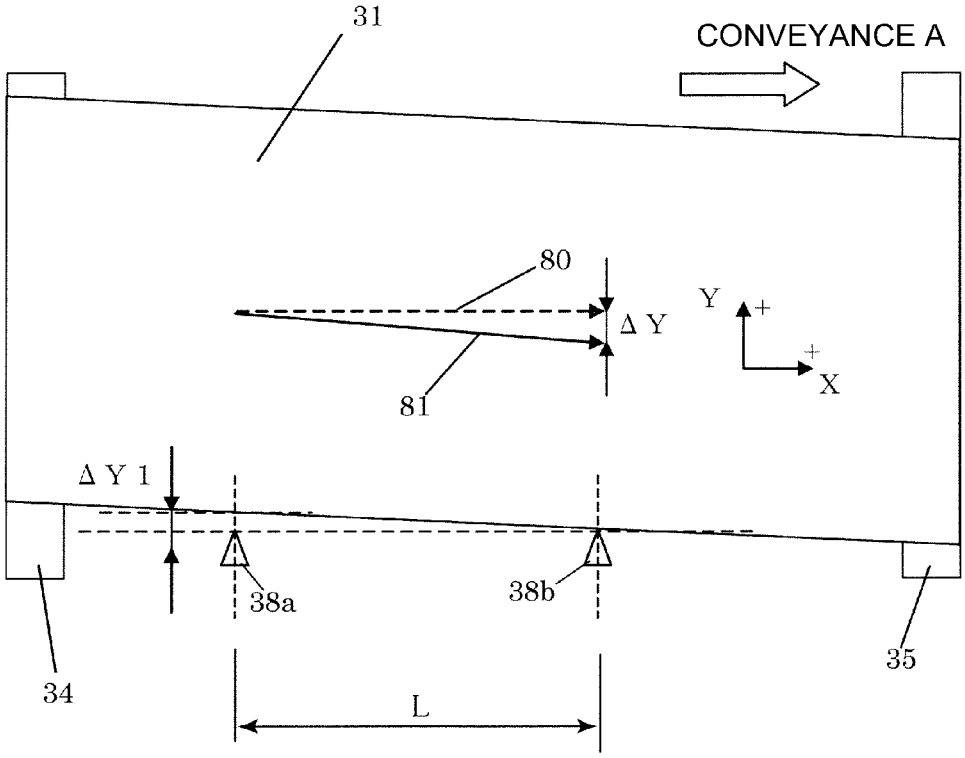

FIG. 9 is an illustration of toner image positional deviation generated by tilting of the intermediary transfer belt.

Figure 10:
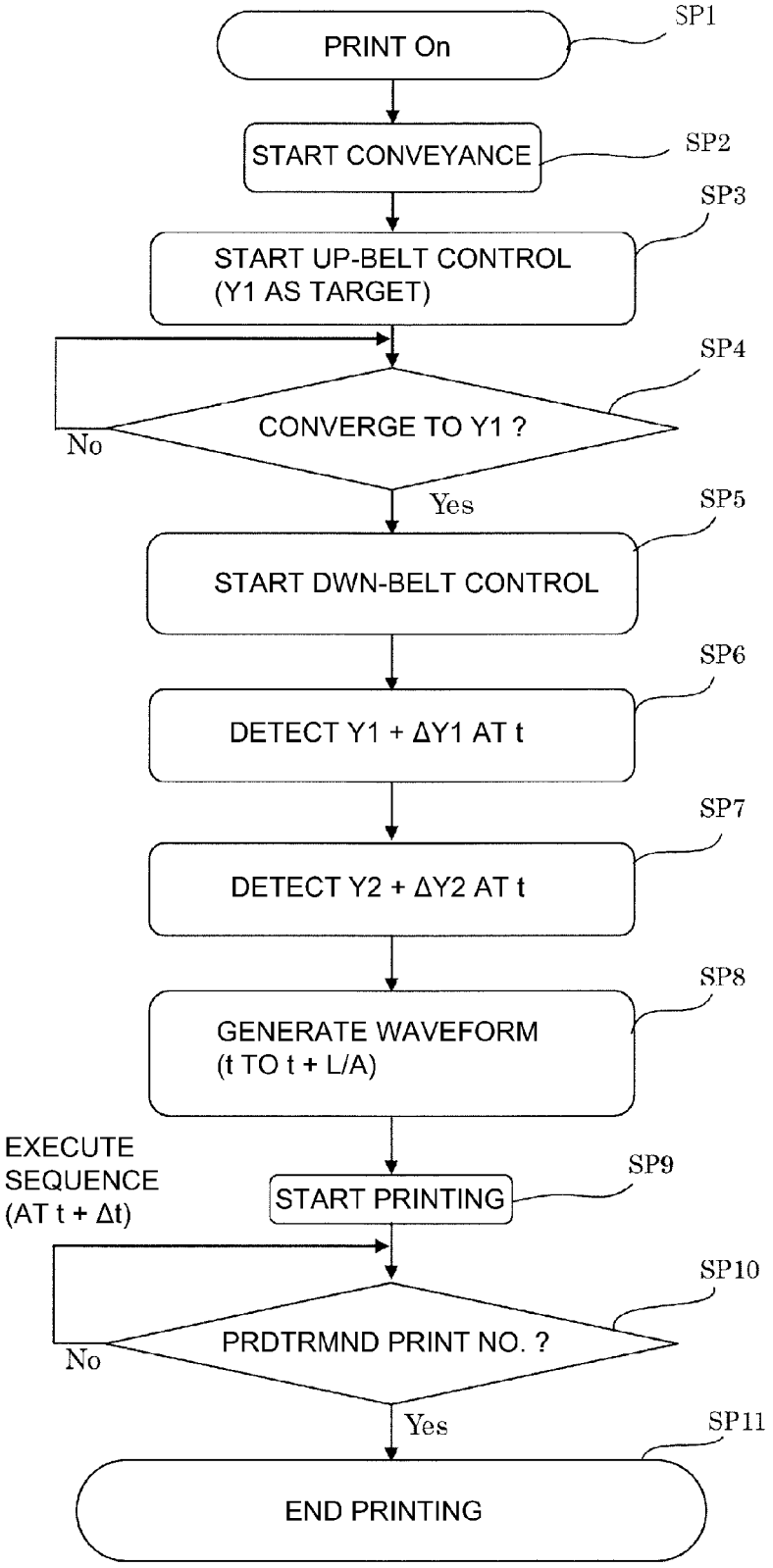

FIG. 10 is a flow chart of lateral movement correction control of the intermediary transfer belt during a printing operation.

Figure 11:
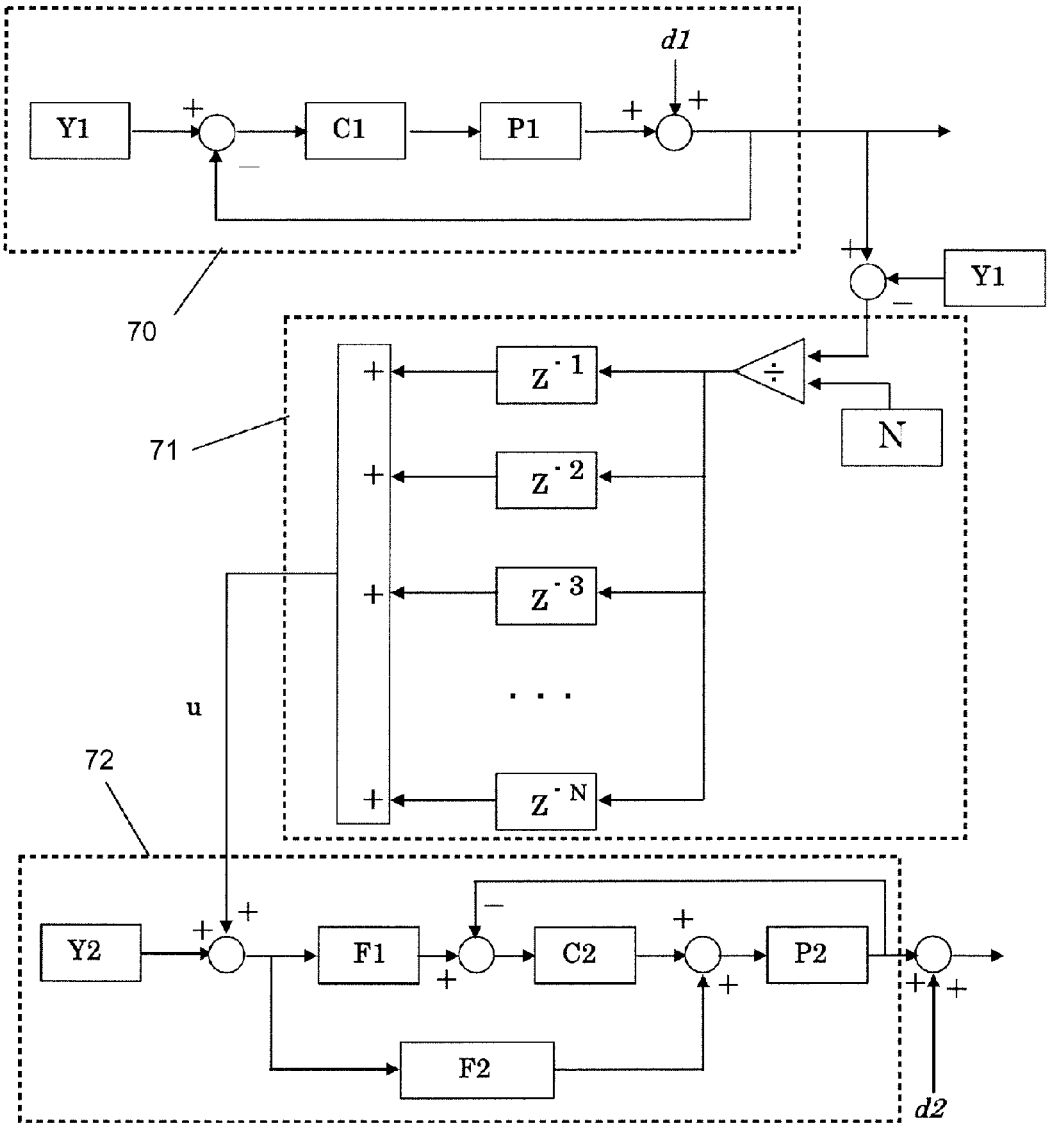

FIG. 11 is a block diagram of transfer function of the lateral movement correction control.

Figure 12:
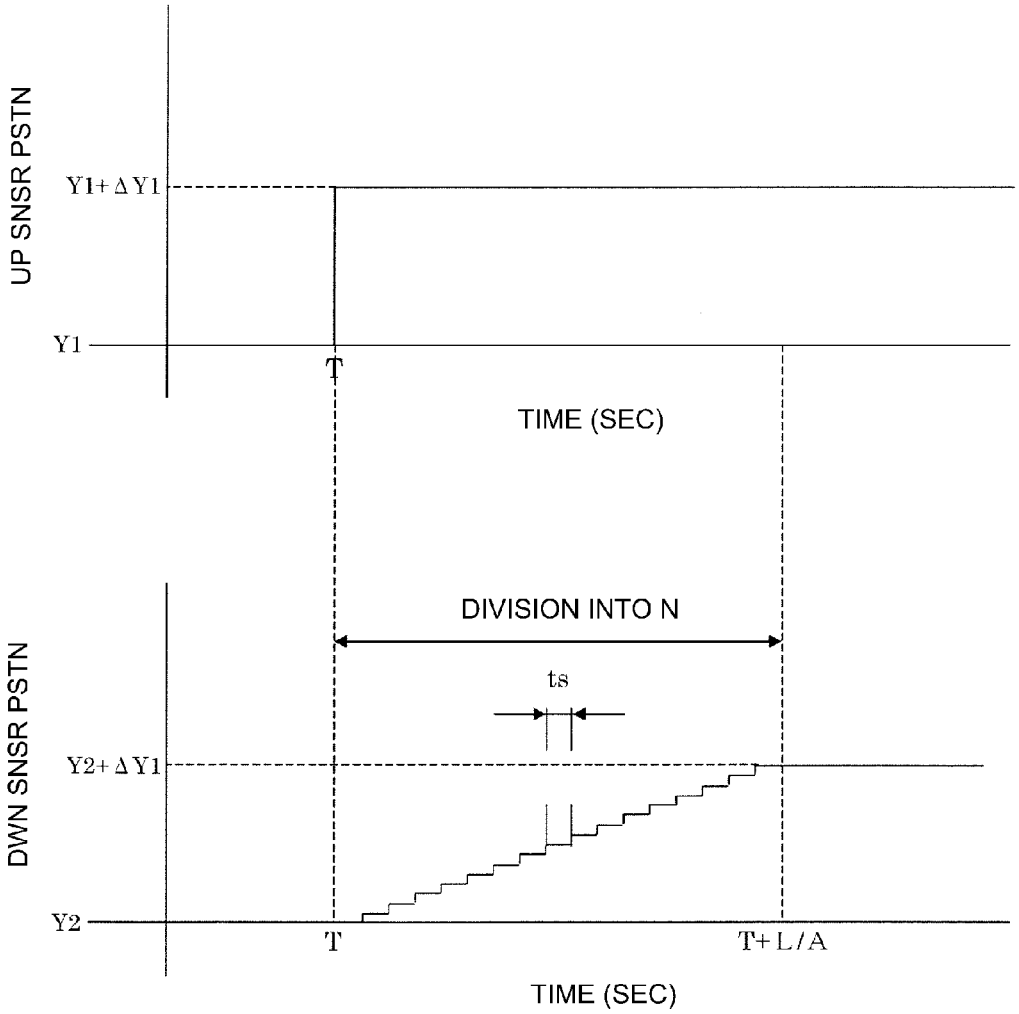

FIG. 12 is an illustration of the lateral movement correction control at a downstream side when stepwise lateral movement is generated at an upstream side.

Figure 13:
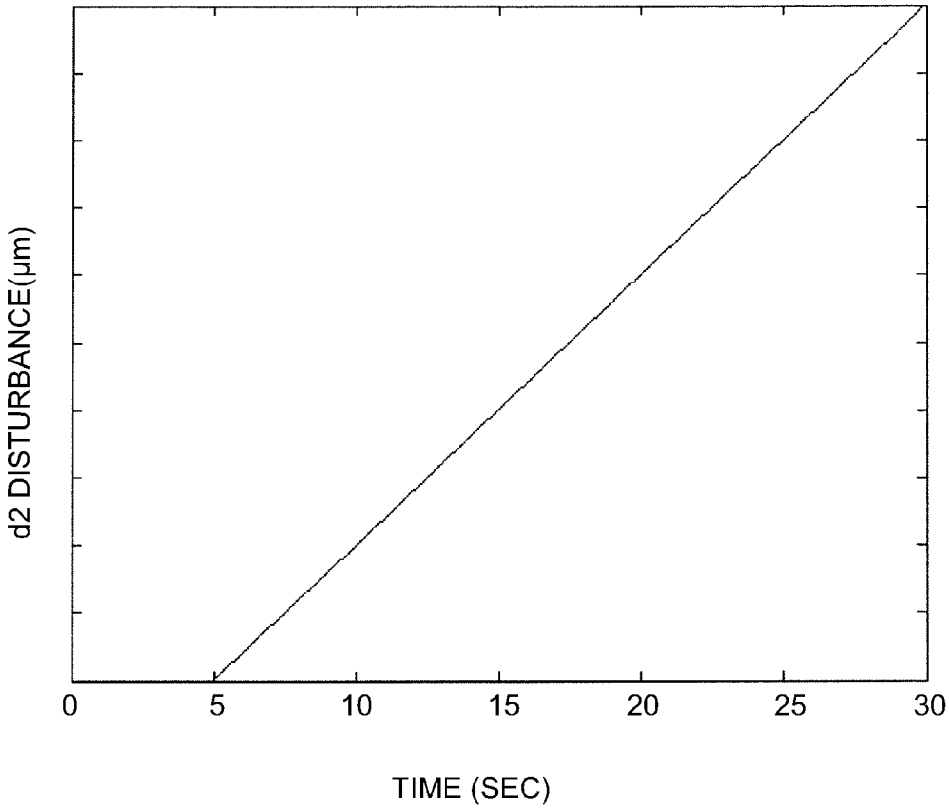

FIG. 13 is an illustration of disturbance of a ramp-like lateral movement.

Figure 14:
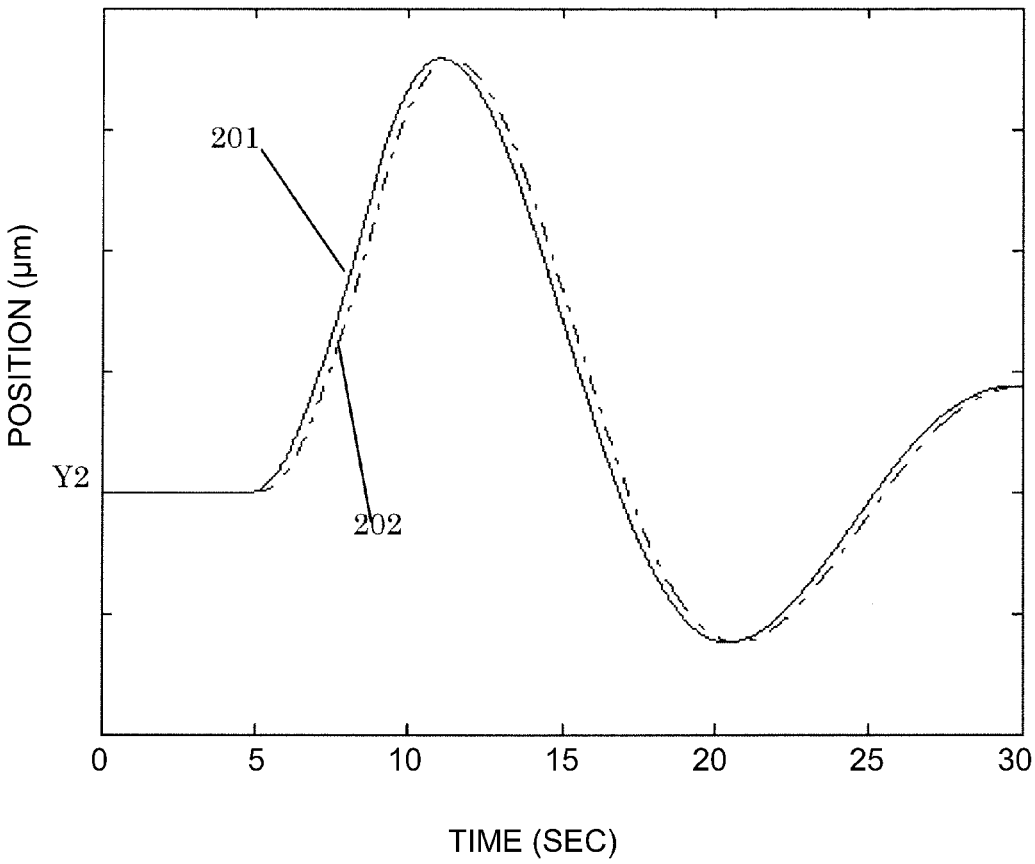

FIG. 14 is an illustration of lateral movement correction control by a steering roller.

Figure 15:
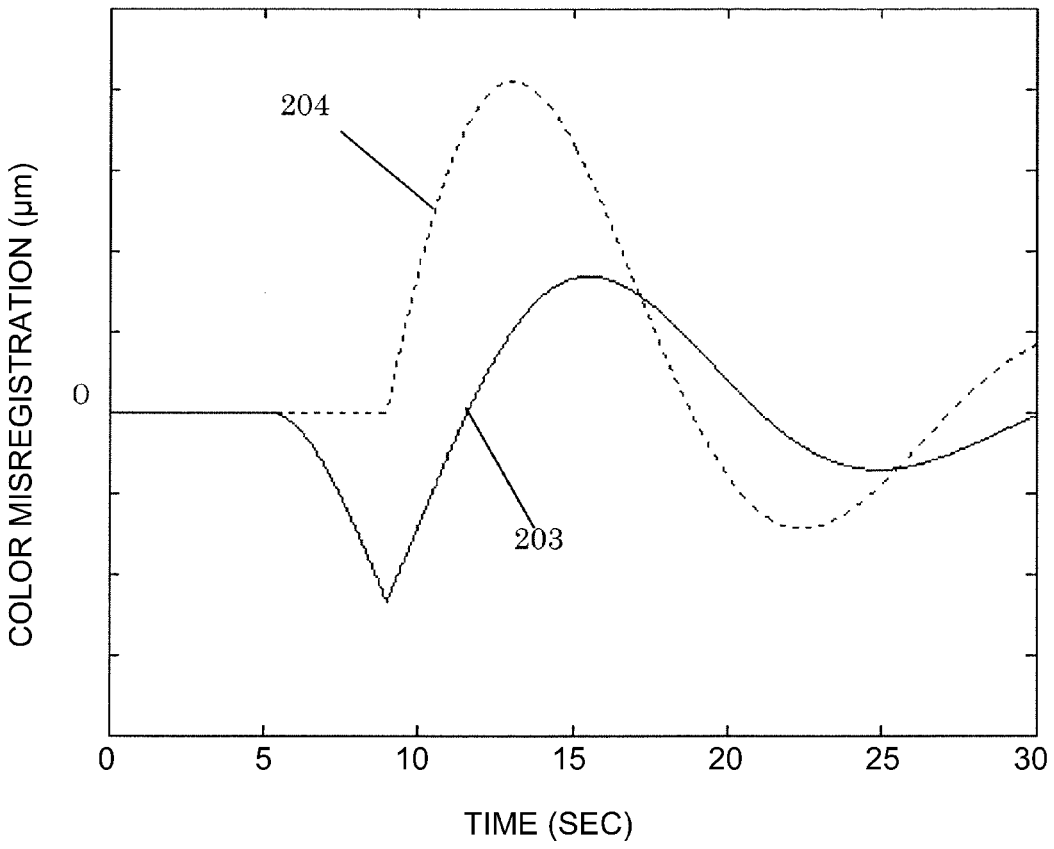

FIG. 15 is an illustration of a color misregistration suppressing effect by the lateral movement correction control.

Figure 16:
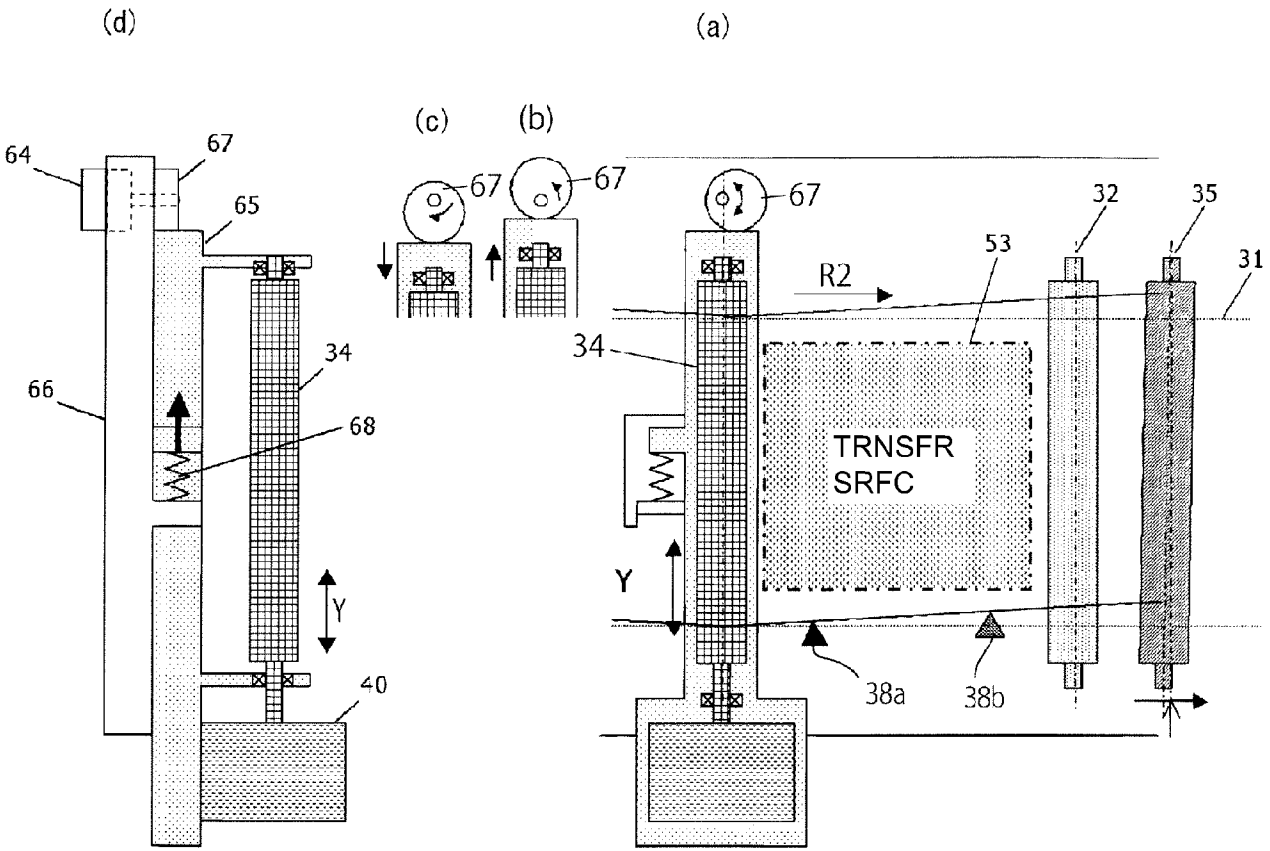

Parts (a) to (d) of FIG. 16 are illustrations of a steering constitution.

Figure 17:
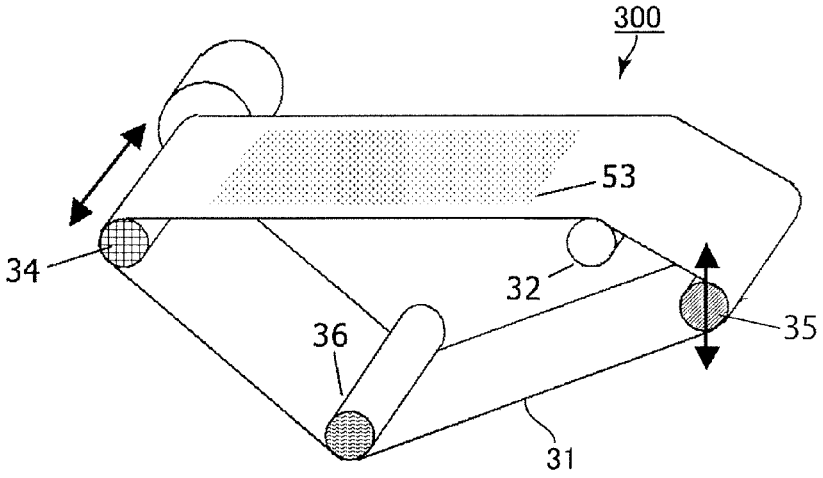

FIG. 17 is an illustration of a structure of an intermediary transfer unit in Embodiment 2.

Figure 18:
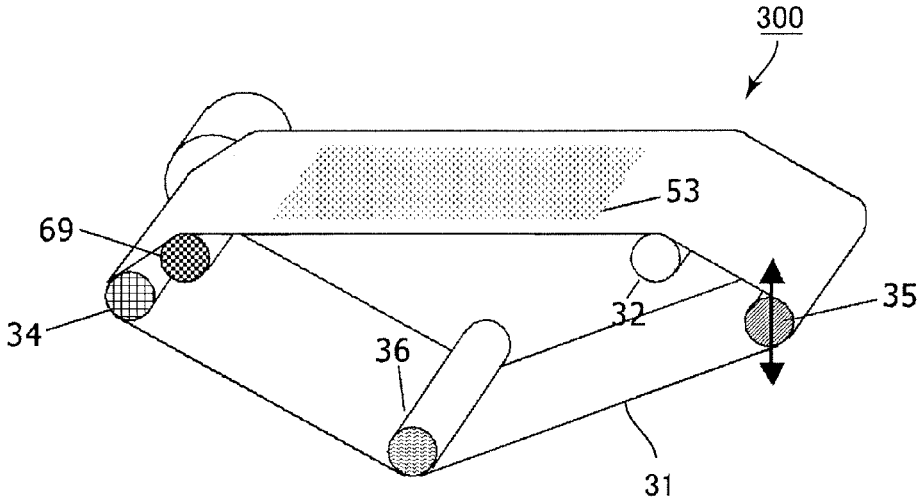

FIG. 18 is an illustration of a structure of an intermediary transfer unit in Embodiment 3.

Figure 19:
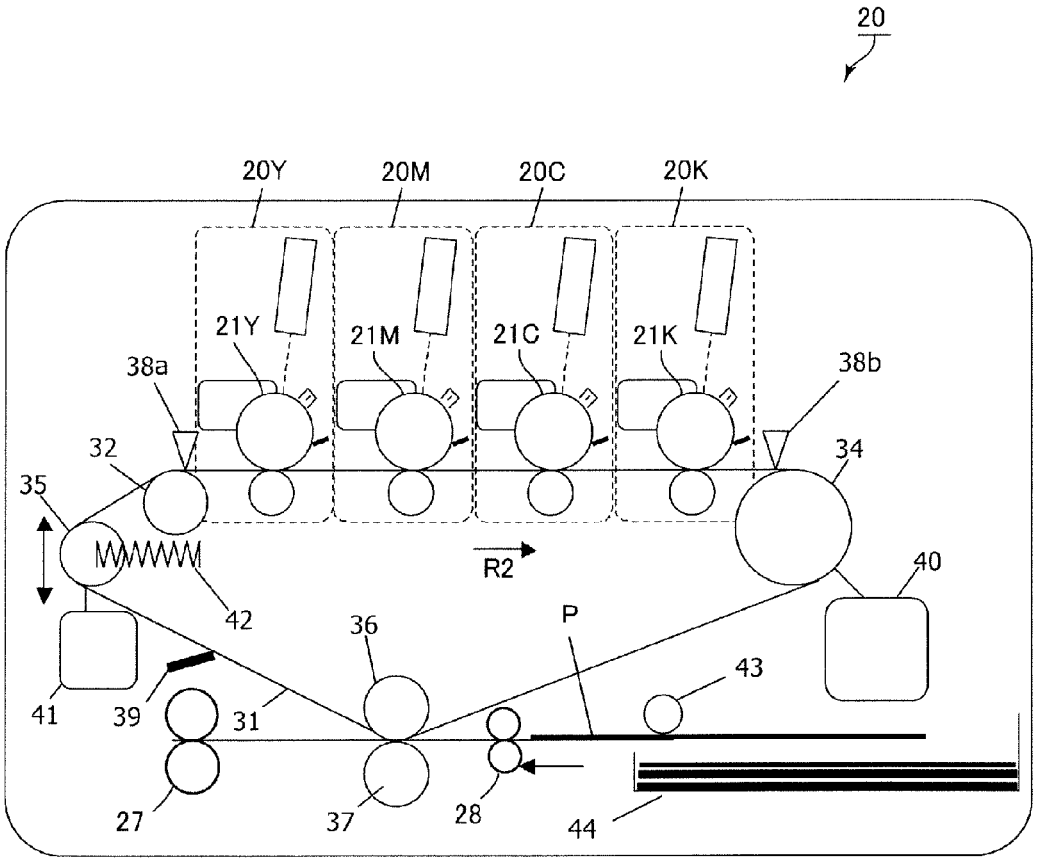

FIG. 19 is an illustration of a structure of an image forming apparatus in Embodiment 4.

DESCRIPTION OF THE PREFERRED EMBODIMENTS

Hereinafter, embodiments of the present invention will be described in detail with reference to the drawings. The present invention can also be carried out in other embodiments in which a part or all of constitution of the following embodiments are replaced with alternative connections so long as an intentional lateral movement amount depending on a state of positional deviation of a toner image on a belt member is formed by steering control at a downstream side.

Therefore, the present invention can be carried out irrespective of a difference between an intermediary transfer type and a recording material conveyance type and in a toner image forming method, a transfer method and a fixing method so long as the image forming apparatus uses the belt member. In the following embodiments, a principal portion relating to formation and transfer of a toner image will be described but the present invention can be carried out in various fields of a printer, various printing machines, a copying machine, a facsimile machine, a multi-function machine, and the like by adding necessary equipment, device and casing structure.

<Image Forming Apparatus>

Figure 1:
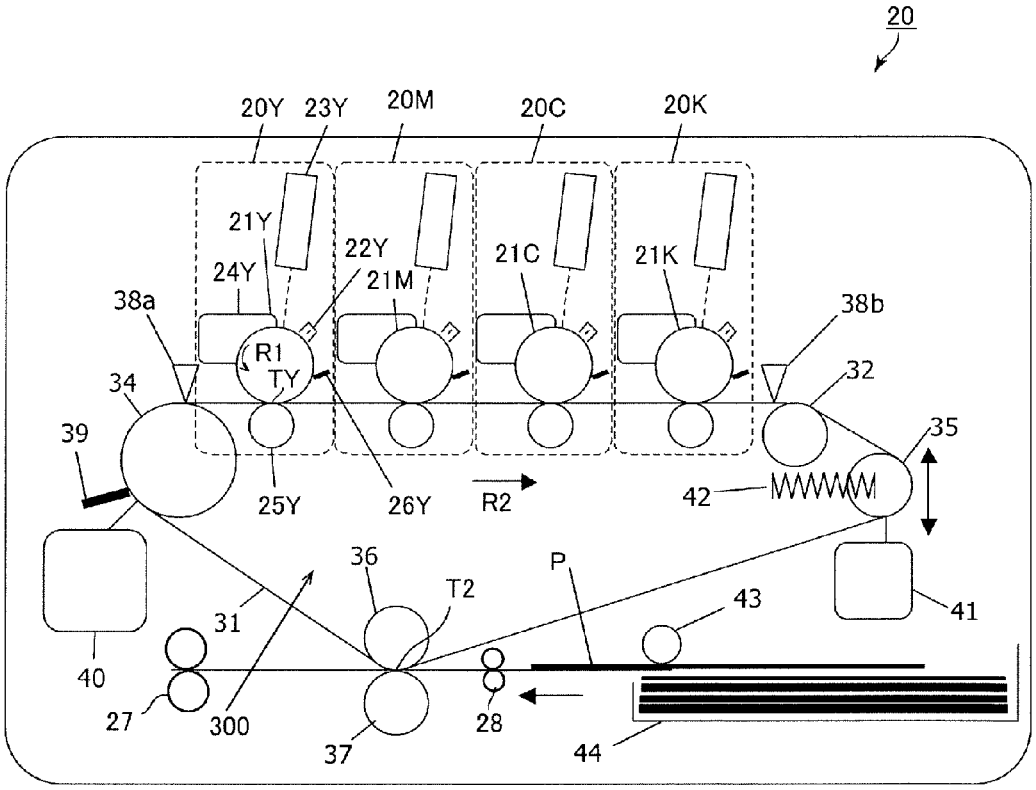
FIG. 1 is an illustration of a structure of an image forming apparatus.

FIG. 1 is an illustration of a constitution of the image forming apparatus.

As shown in FIG. 1, an image forming apparatus 20 is a full-color printer of the tandem type and of the intermediary transfer type in which image forming portions 20Y, 20M, 20C and 20K for yellow, magenta, cyan and black, respectively are sequentially arranged along an intermediary transfer belt 31.

In the image forming apparatus portion 20Y, a yellow toner image is formed on a photosensitive drum 21Y, and is primary-transferred onto the intermediary transfer belt 31. In the image forming portion 20M, a magenta toner image is formed on a photosensitive drum 21M, and is primary-transferred onto the intermediary transfer belt 31. In the image forming portions 20C and 20K, cyan and black toner images are formed on photosensitive drums 21C and 21K, respectively, and are sequentially primary-transferred onto the intermediary transfer belt 31.

Four color toner images transferred onto the intermediary transfer belt 31 are conveyed to a secondary transfer portion T2, in which the toner images are secondary-transferred collectively onto the recording material P. Then, the recording material P on which the toner images are secondary-transferred are curvature-separated from the intermediary transfer belt 31 and are sent to a fixing device 27, in which the recording material P is subjected to heat and pressure, so that the toner images are fixed on the recording material P and then the recording material P is discharged out of the apparatus 20.

The image forming portions 20Y, 20M, 20C and 20K are substantially the same in structure except that colors of the toners used in developing devices 24Y, 24M, 24C and 24K are yellow, magenta, cyan and black, i.e., different from each other. Thus, the yellow image forming portion 20Y will be described below. As for the description of the other image forming portions 20PM, 20C and 20K, the suffix Y of constituent members of the image forming portion PY shall be replaced with M, C and K, respectively.

The image forming portion 20Y includes, at a periphery of a photosensitive drum 21Y, a corona charging device 22Y, an exposure device 23Y, a developing device 24Y, a primary transfer roller 25Y, and a drum cleaning device 26Y. The photosensitive drum 21Y is rotated in the direction indicated by an arrow R1. The corona charging device 22Y uniformly changes the surface of the photosensitive drum 21Y. The exposure device 23Y scans the surface of the photosensitive drum 1Y with a laser beam, obtained by subjecting scanning line image data expanded from a yellow separated color image to ON-OFF modulation, so that an electrostatic image for an image is written (formed) on the photosensitive drum 21Y. The developing device 24Y uses a two component developer containing a toner and a carrier to reversely develop the electrostatic image, so that the toner image is formed on the photosensitive drum 21Y.

The primary transfer roller 25Y contacts the inner surface of the intermediary transfer belt 31 to form a primary transfer portion TY between the photosensitive drum 21Y and the intermediary transfer belt 31. A voltage is applied to the primary transfer roller 25Y, so that the toner image carried on the photosensitive drum 21Y is primary-transferred onto the intermediary transfer belt 31. The drum cleaning device 26Y rubs the photosensitive drum 21Y with the cleaning blade to collect the transfer residual toner.

A secondary toner roller 37 contacts the outer surface of the intermediary transfer belt 31 supported by an opposite roller 36 at the inner surface of the intermediary transfer belt 31 to form a secondary toner portion T2. The recording material P is pulled out one by one from a recording material cassette 44 by a pick-up roller 43 and then is sent to the secondary transfer portion T2 by a registration roller 28. During nip-conveyance of the recording material P in the secondary transfer portion T2, a voltage is applied to the secondary transfer roller 37, so that the full-color toner image is secondary-transferred from the intermediary transfer belt 31 onto the recording material P. A transfer residual toner remaining on the intermediary transfer belt 31 without being transferred is collected by a belt cleaning device 39.

The image forming apparatus 20 performs superposition of the respective color toner images on the intermediary transfer belt 31 and therefore is not influenced by a fluctuation in resistance value of the recording material P due to change or the like of humidity. Further, the respective color toner images are transferred onto the intermediary transfer belt 31 and therefore control of a transfer condition of the respective color toner images becomes easier than that in the case where the toner images are transferred onto the recording material on the recording material conveyer belt. Further, a conveying system is also simplified so that it is possible to prevent jam occurrence as soon as possible.

<Intermediary Transfer Unit>

Figure 2:
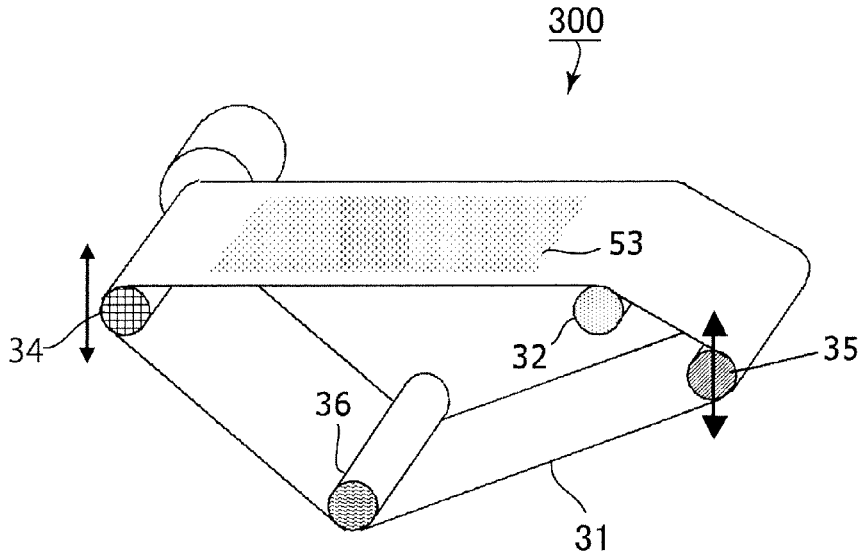
FIG. 2 is an illustration of a structure of an intermediary transfer unit.

FIG. 2 is an illustration of a structure of the intermediary transfer unit. As shown in FIG. 2, the intermediary transfer unit 300 rotatably supports the intermediary transfer belt 31 by a belt driving roller 34, a follower roller 32, a steering roller 35 and an opposite roller 36.

As shown in FIG. 1, the steering roller 35 is urged by a tension spring 42 from the inside to the outside of the intermediary transfer belt 31, thus applying a certain tension to the intermediary transfer belt 31. The steering roller 35 has a supporting point at one end thereof and is movable in directions indicated by an arrow at the other end thereof by a lateral movement correction control motor 41.

The belt driving roller 34 is driven by an unshown driving motor, so that the intermediary transfer belt 31 is moved in the arrow R2 direction. The steering roller 35, the follower roller 32, the primary transfer rollers and the opposite roller 36 are rotated by the rotation of the intermediary transfer belt 31. During the movement of the intermediary transfer belt 31, on the basis of arbitrary output timing, first writing at the image forming portions 20Y, 20M, 20C and 20K are successively started.

In the case where the toner images of the plurality of colors are superposed on the intermediary transfer belt 31, in order to form a high-quality color recording image with no color misregistration, it is important that the intermediary transfer belt 31 is not displaced in the widthwise direction during the rotation.

However, in general, when the belt member formed in an endless shape is extended around a plurality of rotatable supporting members including the driving roller and is rotationally driven, a lateral movement force with respect to an axial direction of the rotatable supporting members acts on the belt member and is displaced in the widthwise direction of the belt member. This is attributable to a shaping error of the belt member, an error of a diameter of the rotatable supporting members, a tilting error of the rotatable supporting members during assembling, and the like.

During the image forming operation, the widthwise position (lateral deviation) of the intermediary transfer belt 31 is dynamically fluctuated by a change of a frictional state of the cleaning blade of the belt cleaning device 39 and the influence of the entering of the recording material P into the secondary transfer portion T2, and the like. When the lateral movement of the intermediary transfer belt 31 is generated, the dynamic fluctuation is generated in the tilting (skew) in the rotational direction of the intermediary transfer belt 31, so that the positional deviation occurs with respect to the superposed toner images and thus the image on which the color misregistration occurs is outputted. Therefore, in the image forming apparatus 20, the belt driving roller 34 and the steering roller 35 are controlled to steer the intermediary transfer belt 31.

<Belt Edge Sensor>

Figure 3:
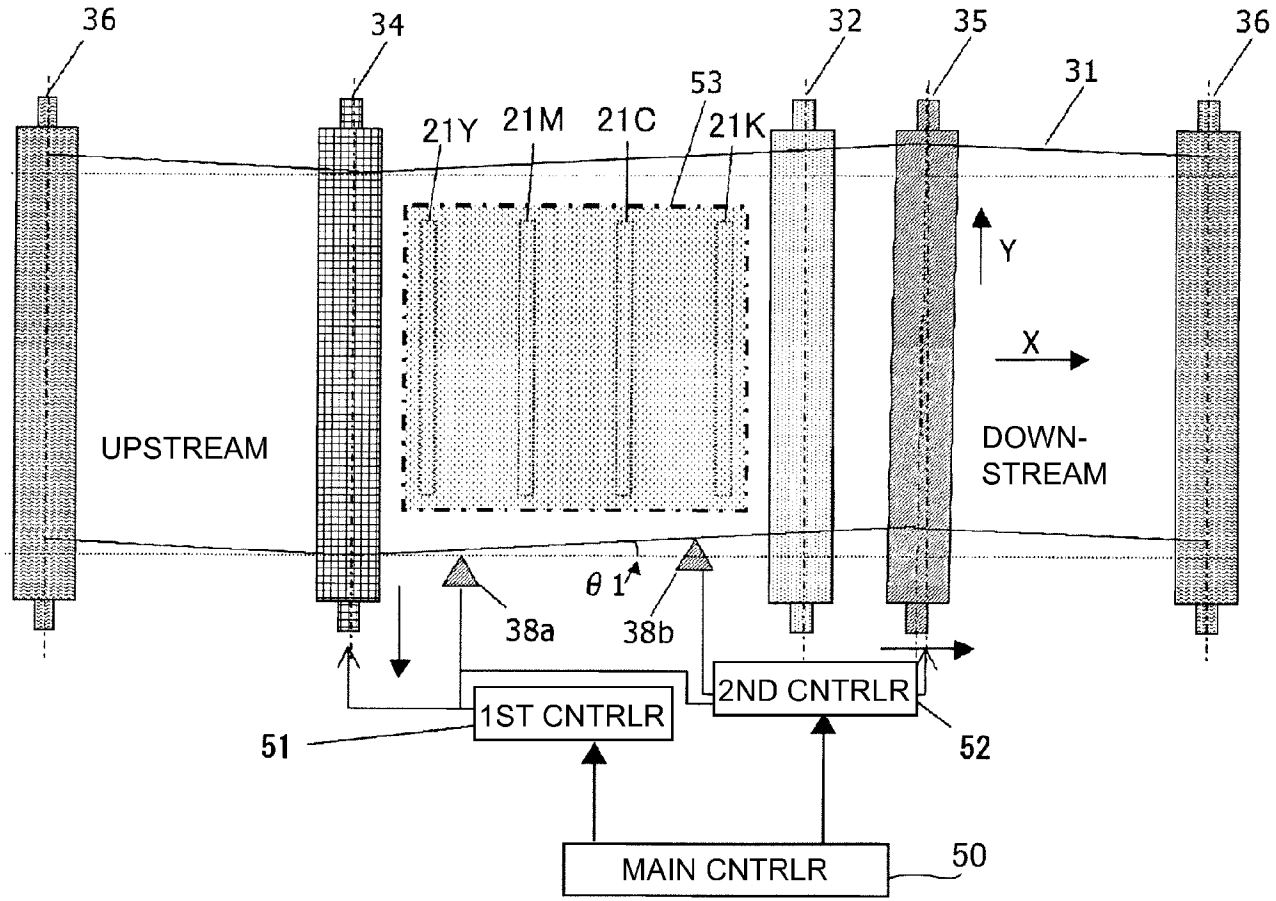
FIG. 3 is an illustration of arrangement of members along an intermediary transfer belt.
Figure 4:
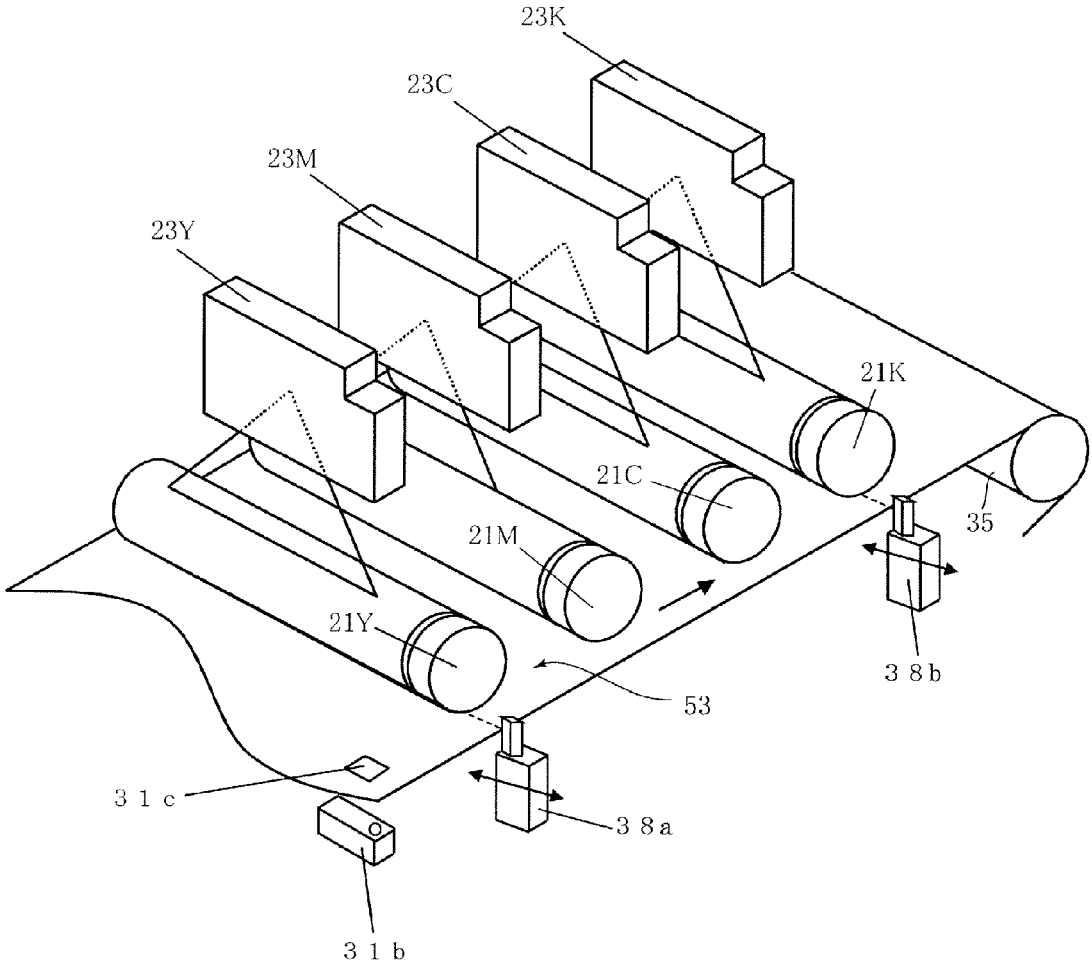
FIG. 4 is an illustration of an arrangement of belt edge sensors.
Figure 5:
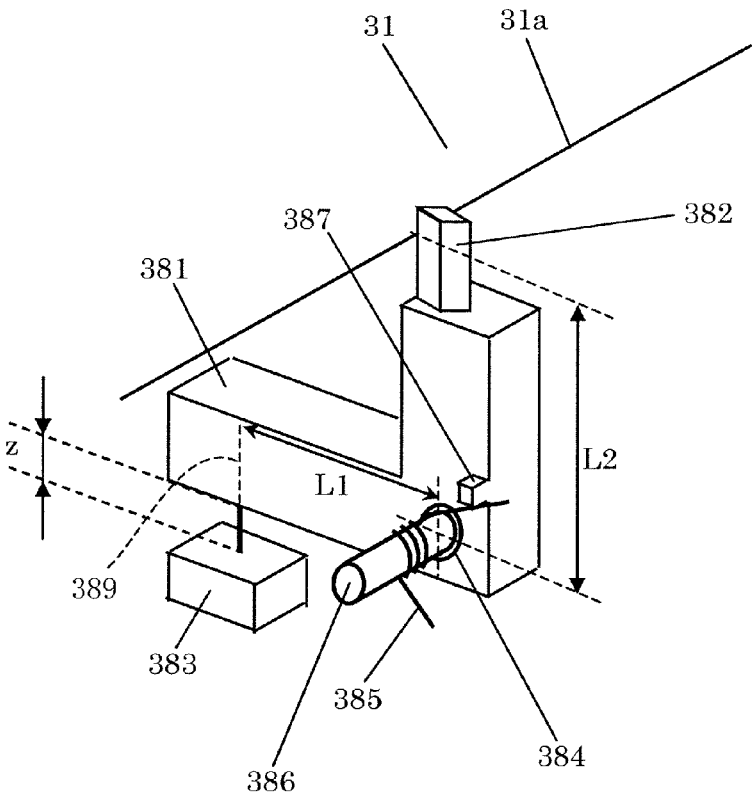
FIG. 5 is an illustration of a structure of each belt edge sensor.

FIG. 3 is an illustration of an arrangement of respective members along the intermediary transfer belt. FIG. 4 is an illustration of an arrangement of belt edge sensors. FIG. 5 is an illustration of each belt edge sensor. In FIG. 3, a belt movement path from the belt driving roller 34 through the steering roller 35 and returned to the belt driving roller 34 is cut at the position of the secondary transfer roller 36 and is developed on a flat surface.

As shown in FIG. 3, a transfer surface 53 is set on the belt movement path in a range from the belt driving roller 34 to the steering roller 35 on the intermediary transfer belt 31, so that the photosensitive drums 21Y, 21M, 21C and 21K are disposed on the transfer surface 53. At different positions with respect to the rotational direction of the intermediary transfer belt 31, an upstream edge sensor 38*a* and a downstream edge sensor 38*b* are provided with a predetermined distance.

The upstream edge sensor 38*a* may only be required to be disposed between the secondary transfer roller 36 and the steering roller 35 but may preferably be disposed between the belt driving roller 34 and the upstreammost photosensitive drum 21Y. This is because the lateral movement amount at the upstream side of the transfer surface 53 is quickly detected and thus a delay of response of the steering operation to the lateral movement of the belt is reduced. Therefore, in the image forming apparatus 20, the upstream edge sensor 38*a* is disposed at the same position as that of the photosensitive drum 21Y with respect to the rotational direction of the intermediary transfer belt 31.

The downstream edge sensor 38*b* may only be required to be disposed between the upstream edge sensor 38*a* and the secondary transfer roller 36 but may preferably be disposed between the downstreammost photosensitive drum 21K and the steering roller 35 in order to improve steering responsiveness. Therefore, in the image forming apparatus 20, the downstream edge sensor 38*b* is disposed at the same position as that of the photosensitive drum 21K with respect to the rotational direction of the intermediary transfer belt 31.

As shown in FIG. 4, the upstream edge sensor 38*a* is disposed so as to detect the belt position at the position of the upstreammost photosensitive drum 21Y on the transfer surface 53. Further, the downstream edge sensor 38*b* is disposed so as to detect the belt position at the position of the downstream most photosensitive drum 21K on the transfer surface 53. The upstream edge sensor 38*a* and the downstream edge sensor 38*b* detect the position of the intermediary transfer belt 31 at their positions and have the same sensor constitution.

As shown in FIG. 5, a sensor flag 381 is attached to a rotational shaft 386 mounted to the intermediary transfer unit by inserting the rotation shaft 386 into a rotation center hole 384, thus being rotationally movable about the rotation shaft 386. Around the rotation shaft 386, a torsion (helical) coil spring 385 is provided and engages with a flag hook 387 to urge the sensor flag 381 in the counterclockwise direction in FIG. 5, so that an edge abutment plate 382 is contacted to a belt edge 31*a*.

Below the sensor flag 381, a distance measuring sensor 383 is provided and measures a distance Z between the sensor flag 381 and the distance measuring sensor 383.

When a distance from flag detection position 389 to the rotation center 384 is L1 and a distance from the belt edge 31*a* to the rotation center hole 384 is L2, a belt detect Y can be determined by the following equation.

$$Y=Z\times L1/L2$$

<Steering Mechanism>

Parts (a) to (c) of FIG. 6 are illustrations of the steering mechanism. As shown in FIG. 2, the image forming apparatus 20 can adjust the position of the intermediary transfer belt 31 with respect to a belt widthwise direction y by controlling a tilting direction and tilting amount (tilting angle) of the steering roller 35.

A second controller 52 outputs a control signal on the basis of detection signals sent from the upstream edge sensor 38*a* and the downstream edge sensor 38*b*, thus controlling a tilting operation of the steering roller 35 at the downstream side of the transfer surface 53. The control signal outputted from the second controller 52 is sent to a driving portion (steering motor or the like) of a mechanical mechanism for performing the tilting operation of the steering roller 35.

As shown in (a) of FIG. 6, a swing arm 62 is rotatably supported by a supporting shaft 61 at its intermediate portion. One end of the steering roller 35 is rotatably connected to one end of the swing arm 62 and the other end of the swing arm 62 is press-contacted to an eccentric cam 60. The eccentric cam 60 is connected to a rotation shaft of the lateral movement correction control motor 41.

From a neutral state shown in (a) of FIG. 6, when the lateral movement correction control motor 41 rotates the eccentric cam 60 in a CW (clockwise) direction, the swing arm 62 is swung in the CW direction as shown in (b) of FIG. 6. As a result, the steering roller 35 is tilted and operated so that its rear side portion is displaced in an upward direction and then in interrelation with this operation, the intermediary transfer belt 31 is moved toward the front side in the widthwise direction y.

On the other hand, from a neutral state shown in (a) of FIG. 6, when the lateral movement correction control motor 41 rotates the eccentric cam 60 in a CCW (counterclockwise) direction, the swing arm 62 is swung in the CCW direction as shown in (c) of FIG. 6. As a result, the steering roller 35 is tilted and operated so that its rear side portion is displaced in an upward direction and then in interrelation with this operation, the intermediary transfer belt 31 is moved toward the rear side in the widthwise direction y.

In the image forming apparatus 20, also with respect to the belt driving roller 34, the same steering function as that as shown in (a) to (c) of FIG. 6 is provided, so that the position of the intermediary transfer belt 31 with respect to the belt widthwise direction y is controlled also at the upstream side.

As shown in FIG. 2, a first controller 51 calculates an amount of meandering (walk) of the intermediary transfer belt 31 on the basis of the detection signal sent from the upstream edge sensor 38*a*. Then, the first controller 51 outputs a control signal depending on a calculation result of the amount of meandering to control the tilting operation of the belt driving roller 34 at the upstream side of the transfer surface 53. The control signal outputted from the first controller 51 is sent to a driving portion (steering motor or the like) of a mechanical mechanism for performing the tilting operation of the belt driving roller 34.

<Lateral Movement Correction Control During Actuation>

FIG. 7 is a flow chart of a pre-rotation operation of the intermediary transfer belt before the image formation. As shown in FIG. 7 with reference to FIG. 3, a main controller 50 receives a pre-rotation operation start instruction (SM1) and then starts a shape obtaining operation of the belt edge 31*a* (SM2).

The purpose of performing the belt edge shape obtaining operation is to eliminate the influences of stepping and bending of a cutting shape of the belt edge in the lateral movement correction control. In a belt position detecting method as shown in FIG. 5, even when the intermediary transfer belt is conveyed with no meandering and no oblique movement, the belt edge sensor recognizes the stepping and bending of the cutting shape of the belt edge as the meandering or oblique movement.

The main controller 50 first tilts the upstream and downstream steering members to the position in which a lateral movement speed of the belt is zero (SM3) and thereafter stops the lateral movement correction control and then starts the belt conveying operation (SM4).

As shown in FIG. 4, a seal member 31*c* is applied to the inner peripheral surface of the intermediary transfer belt 31. A belt home position sensor 31*b* provided inside the intermediary transfer unit detects passing of the seal member 31*c* and determines that the position of the intermediary transfer belt 31 at the detection timing is a home position for one full circumference of the intermediary transfer belt 31.

The main controller 50 starts the rotation of the intermediary transfer belt 31 to rotate the intermediary transfer belt 31 by M full circumferences and then obtains a belt edge shape data (SM5). At that time, the shape is obtained by using the belt home position sensor 31*b* in synchronism with the home position detection for one full circumference of the belt, the data can be converted into the belt edge shape data every one full circumference. After the shape data for the M full circumferences is obtained, the shape data is subjected to averaging, so that it is possible to reduce the belt conveyance non-uniformity and the influence of a noise component at the time of obtaining the shape data.

The main controller 50 starts, after the obtaining the belt edge shape data is completed by each of the upstream edge sensor 38*a* and the downstream edge sensor 38*b*, a control target value searching operation (SM6).

In the control target value searching operation, first, the belt edge shape of the moving belt 31 is corrected, so that a factor of the influence of the belt edge shape on the edge sensors 38*a* and 38*b* (SM7).

Thereafter, on the basis of the output of the upstream edge sensor 38*a*, the lateral movement correction control is executed by only the upstream belt driving roller 34, so that the belt position at the upstream edge sensor 38*a* is controlled toward a predetermined target position Y1 (SM8).

When the belt position at the upstream edge sensor 38*a* converges to the position Y1 (Yes of SM9), the belt position is detected by the downstream edge sensor 38*b*, so that the intermediary transfer belt 31 is rotated by several full circumferences. Then, an average of the belt positions detected by the downstream edge sensor 38*b* during the rotation is calculated (SM10).

The average of the belt positions detected by the downstream edge sensor 38*b* is taken as Y2 and then when a control target value data is obtained, the control target value searching operation is ended (SM11).

The main controller 50 thereafter stops the conveying operation of the intermediary transfer belt 31 and ends the lateral movement correction control of the belt driving roller 34, thus completing the pre-rotation operation (SM12).

<Toner Image Positional Deviation>

FIG. 8 is an illustration of the tilting of the intermediary transfer belt detected by the belt edge sensors. FIG. 9 is an illustration of the toner image positional deviation generated by the tilting of the intermediary transfer belt.

As shown in FIG. 8, during the conveyance of the intermediary transfer belt 31, each of the upstream edge sensor 38*a* which is an example of a first detecting means and the downstream edge sensor 38*b* which is an example of a second detecting means detects a belt lateral movement (deviation) amount. At this time, a line connecting a reference position Y1 of the upstream edge sensor 38*a* and a reference position Y2 of the downstream edge sensor 38*b* is defined as reference vector 80. In many cases, the reference positions Y1 and Y2 provide different outputs but may also be the same value. A deviation amount from the reference position Y1 for the detection position by the upstream edge sensor 38*a* is ΔY1 and a deviation amount from the reference position Y2 for the detection position by the downstream edge sensor 38*b* is ΔY2.

In this case, as shown in FIG. 9, color misregistration with the fluctuation of the belt conveyance direction occurs. In FIG. 9, in order to simplify the description, it is assumed that the belt positional deviation occurs by Y1 at the position of the upstream edge sensor 38*a*.

Thus, when an attitude of the intermediary transfer belt 31 is changed, in order to prevent complete lateral movement of the intermediary transfer belt 31, there is a need to effect the lateral movement correction control with respect to the same conveyance direction as that of the tilting of the intermediary transfer belt 31.

However, at the position of the downstream edge sensor 38*b*, color misregistration ΔY due to the fluctuation in conveyance direction occurs. A conveyance direction vector 81 is deviated from the belt reference vector 80 defined during the pre-rotation operation and therefore the color misregistration occurs even when the lateral movement is not generated.

On the other hand, the color misregistration is not generated when the conveyance direction is kept constant but the intermediary transfer belt 31 causes the lateral movement and eventually the intermediary transfer belt 31 is completely laterally deviated and is disconnected from the belt driving roller 34.

Thus, the certain conveyance direction (improvement (prevention) of color misregistration) and suppression of the lateral movement cannot be realized by the single steering roller. In order to compatibly realize the improvement of the color misregistration and the suppression of the lateral movement, there is a need to provide at least two steering rollers and to align the conveyance direction of the intermediary transfer belt 31 with the reference vector 80.

Further, in Embodiment 1, in order to realize the improvement of the color misregistration and the complete lateral movement prevention, in synchronism with the lateral movement generated at the upstream side, the target value of the downstream side lateral movement correction control is changed in real time.

Embodiment 1

FIG. 10 is a flow chart of the lateral movement correction control of the intermediary transfer belt during the printing operation. FIG. 11 is a block diagram of transfer function of the lateral movement correction control.

A control sequence of the upstream and downstream lateral movement correcting means during the printing operation will be described with reference to FIG. 10, and the lateral movement correction control of the upstream steering roller and the downstream steering roller will be described with reference to FIG. 11.

As shown in FIG. 3, in Embodiment 1, the photosensitive drum 21Y which is an example of a first image bearing member transfers the yellow toner image which is an example of a first toner image onto the intermediary transfer belt 31 which is an example of the belt member. The photosensitive drum 21K which is an example of a second image bearing member transfers the black toner image which is an example of a second toner image onto the intermediary transfer belt 31 on which the yellow toner image is transferred.

The belt driving roller 34 which is an example of a first steering means (first steering roller) tilts at a position before a position in which the intermediary transfer belt 31 enters the position of the photosensitive drum 21Y, thus moving the intermediary transfer belt 31 in the widthwise direction. The belt driving roller 34 effects the lateral movement correction control of the intermediary transfer belt 31, before entering the position of the photosensitive drum 21Y, so that the toner image is transferred from the photosensitive drum 21Y onto the intermediary transfer belt 31 at a predetermined position with respect to the widthwise direction of the intermediary transfer belt 31.

The steering roller 35 which is an example of a second steering means (second steering roller) tilts at a position after a position in which the intermediary transfer belt 31 passes through the position of the photosensitive drum 21K, thus moving the intermediary transfer belt 31 in the widthwise direction. The steering roller 35 effect the lateral movement correction control of the intermediary transfer belt 31, after passing through the position of the photosensitive drum 21K, when the lateral movement of the intermediary transfer belt 31 is generated at the position of the photosensitive drum 21K with respect to the widthwise direction of the intermediary transfer belt 31.

The first controller 51 which is an example of a first means controls the belt driving roller 34 on the basis of the output of the upstream edge sensor 38*a*. As a result, the lateral movement is converged in a state in which the intermediary transfer belt 31 is located at a predetermined position with respect to the longitudinal direction of the photosensitive drum 21Y.

The second controller 52 which is an example of a second control means controls the steering roller 35 on the basis of the output of the downstream edge sensor 38*b*. As a result, the lateral movement is converged in a state in which the belt member is located at a position corresponding to the amount of the lateral movement generated with respect to the intermediary transfer belt 31.

In Embodiment 1, during the printing operation, the belt driving roller 34 effects the belt lateral movement correction control on the basis of the output of the upstream edge sensor 38*a*. Further, the steering roller 35 effects the conveyance direction control of the intermediary transfer belt 31 on the basis of the outputs of the upstream edge sensor 38*a* and the downstream edge sensor 38*b*.

As shown in FIG. 10 with reference to FIG. 3, the main controller 50 starts, when a printing operation instruction is provided (SP1), the belt conveyance operation (SP2). Immediately thereafter, the main controller 50 starts the lateral movement correction control of the intermediary transfer belt 31 by the belt driving roller 34, so that the upstream belt position detected by the upstream edge sensor 38*a* is induced toward the reference position Y1 (SP3).

As shown in FIG. 11 with reference to FIG. 3, an upstream steering roller control block 70 controls a tilting amount of the belt driving roller 34 to effect normal lateral movement correction control. The upstream steering roller control block 70 controls the tilting amount of the belt driving roller 34, so that disturbance is converged by feedback positional control using the reference position Y1 of the upstream edge sensor 38*a* as a target value.

A controller C1 in the upstream steering roller control block 70 is the first controller 51. A plant transfer function P1 represents a steering lateral movement characteristic of the belt driving roller 34 controlled by the first controller 51. The plant transfer function P1 is a computing element (unit) having a predetermined frequency characteristic including the steering tilting amount (mm) as an input and the lateral movement fluctuation amount (mm) as an output. The disturbance d1 is the lateral movement amount of the belt detected by the upstream edge sensor 38*a* after the meandering or oblique movement of the intermediary transfer belt 31 is generated.

The upstream belt position detected by the upstream edge sensor 38*a* converges to the reference position Y1 (Yes of SP4) and thereafter the upstream side lateral movement correction control of the belt by the steering roller 35 is started (SP5).

In the upstream side lateral movement correction control of the belt, the tilting amount of the steering roller 35 is computed on the basis of the upstream belt position detected by the upstream edge sensor 38*a* and the downstream belt position detected by the downstream edge sensor 38*b*.

The second controller 52 detects the upstream belt position Y1+ΔY1 at a certain time t (SP6) and also detects the downstream belt position Y2+ΔY2 at the time t (SP7).

Here, a distance between the upstream edge sensor 38*a* and the downstream edge sensor 38*b* is L (mm), and the belt conveyance speed is A (mm/sec).

The toner image transferred from the upstream photosensitive drum 21Y onto the intermediary transfer belt 31 at the time t reaches the position of the position of the downstream edge sensor 38*b* after a lapse of Δt.

$$\Delta t = L/A$$

For this reason, the widthwise steering roller 35 generates a target orbit waveform thereof in a period from the time t to the time (t+L/A) and then effect the tilting control so as to follow the waveform (SP8).

Thereafter, the main controller 50 starts the printing operation (SP9). Then, when the print number reaches a predetermined number (Yes of SP10), the printing operation is ended (SP11).

<Downstream Side Lateral Movement Correction Control of Belt>

As shown in FIG. 3, the second controller 52 controls the steering roller 35 so that the lateral movement amount generated for the intermediary transfer belt 31 is increased with an increase of the lateral movement amount of the intermediary transfer belt 31 generated at the position of the photosensitive drum 21Y with respect to the widthwise direction of the intermediary transfer belt 31.

The second controller 52 controls the steering roller 35, so that the lateral movement amount of the intermediary transfer belt 31 is slowly changed. This is because an abrupt change of the lateral movement amount generates large and conspicuous color misregistration. Then, with continuation of the lateral movement of the belt generated for a longer time at the position of the photosensitive drum 21Y, the lateral movement amount generated for the intermediary transfer belt 31 is increased within a range not exceeding the movement amount generated at the position of the photosensitive drum 21Y.

The lateral movement amount generated for the intermediary transfer belt 31 is proportional to a value transfer integral of a difference value, between the outputs of the upstream edge sensor 38*a* and the downstream edge sensor 38*b*, for movement time of the intermediary transfer belt 31 from the position of the photosensitive drum 21Y to the position of the detect 21K.

As shown in FIG. 8, as a result of the upstream steering roller positional control, the belt position detected by the upstream edge sensor 38*a* is taken as Y1+ΔY1. Here, at a time (T+L/A), when the belt position detected by the downstream edge sensor 38*b* is Y2+ΔY1, in an amount corresponding to the positional deviation of ΔY1 due to the disturbance at the position of the photosensitive drum 21Y, the color misregistration does not occur at the position of the photosensitive drum 21K.

Therefore, in this embodiment, on the basis of the difference value, between the outputs of the upstream and downstream edge sensors 38*a* and 38*b*, varying every moment, the target orbit waveform of the steering roller 35 in a period from the time t to the time (t+L/A) is generated. Then, the tilting amount of the steering roller 35 is controlled so that the belt position detected by the downstream edge sensor 38*b* converges to the target value on the target orbit waveform every moment.

Specifically, with respect to the conveyance direction between the upstream edge sensor 38*a* and the downstream edge sensor 38*b*, the distance is defined as L, the belt conveyance speed is defined as A, and a discrete sampling time of the control is defined as ts. Further, a memory for storing the difference value from the target value at the position of the upstream edge sensor 38*a* with respect to N samples from a sample before (T/A/Ts) time to the immediately before sample is provided.

In that case, a constitution in which a value u obtained by adding data of the N samples stored in the memory and then driving the added data by N is equal to the target value of the lateral movement correction control at a current time at the position of the downstream edge sensor 38*b* is employed.

As shown in FIG. 11 with reference to FIG. 3, a specific algorithm for a downstream steering roller control block 72 and a downstream steering roller target value orbit generation block 71 is assembled. The downstream steering roller target value orbit generation block 71 computes the reference position every moment used in the downstream steering roller control block 72. The downstream steering roller control block 72 controls the tilting amount so that the belt position converges to the reference position computed every moment.

Here, the discrete sampling time in the control is (sec), and the time L/A divided by the discrete sampling time into N sections. The downstream steering roller target value orbit generation block 71 generates makes approximation of the difference value between the belt position detected by the upstream edge sensor 38*a* and the belt position detected by the downstream edge sensor 38*b* by the difference value ΔY1 and generates data Z by dividing the difference value Y1 by N.

$$Z = \Delta 1/N$$

Then, Z is used as a discrete operator to add output values from Z−1 for the immediately before sample to Z−N for the preceding sample by N. By such an algorithm for the transfer integral, every sampling timing, the reference value in the lateral movement correction control of the steering roller 35 is generated. Then, the downstream steering roller control block 72 executes the lateral movement correction control so that the output of the downstream edge sensor 38*b* converges to this reference value.

The downstream steering roller control block 72 establishes a two-degree-of-freedom control system including a feedforward compensator F2 for improving a target value following property, a predistorter F2 using a command as an input, and a feedback controller C2 with respect to the disturbance d2. By the action of the feedforward compensator F2, an actual belt lateral movement behavior is caused to approach the target value orbit.

As a result, a response speed of the steering roller 35 to the change of the output of the downstream edge sensor 38*b* is higher than a response speed of the belt driving roller 34 to the output of the upstream edge sensor 38*a*.

Further, in that case, the feedforward compensator F2 is adjusted so that disturbance suppressing control by the feedback controller C2 by the action of the predistorter F1 and target value following control by the action of the feedforward compensator F2 are independently effected.

<Control Example in Embodiment 1>

FIG. 12 is an illustration of the lateral movement correction control at an downstream side when stepwise lateral movement is generated at an upstream side. FIG. 13 is an illustration of disturbance of a ramp-like lateral movement. FIG. 14 is an illustration of lateral movement correction control by a steering roller. FIG. 15 is an illustration of a color misregistration suppressing effect by the lateral movement correction control.

As shown in FIG. 12, at the time T, it is assumed that the disturbance ΔY1 is stepwisely caused on the intermediary transfer belt 31 at the position of the upstream edge sensor 38*a*. At this time, the target value orbit of the lateral movement correction control by the steering roller 35 is computed every moment so that a step of a height ΔY1/10 is gradually accumulated in the time ts.

The target value orbit, of the lateral movement correction control by the steering roller 35, generated by the algorithm for the downstream steering roller target value generation block 71 changed in a ramp manner to reach Y2+ΔY1 at the time (T+L/A).

Thus, the positional deviation of ΔY1 at the position of the photosensitive drum 21Y at the time T is eliminated by shifting the target position of the lateral movement correction control by the steering roller 35 by ΔY1 after the lapse of the time L/A, so that the color misregistration at the position of the photosensitive drum 21K is suppressed.

Next, as shown in FIG. 13, it is assumed that a ramp-like disturbance occurs at the time 5 (sec) as a starting point. The target value orbit of the lateral movement correction control by the steering roller 35 when the ramp-like disturbance d1 is generated in the upstream steering roller control block 70 is shown in FIG. 14 by a solid line 201. Further, the output of the downstream edge sensor 38*b* as a result of the lateral movement correction control effected by tilting the steering roller 35 with respect to the target value orbit is shown in FIG. 14 by a chain line 202. By the action of the feedforward compensator F2 shown in FIG. 11, the actual belt lateral movement behavior indicated by the chain line 202 is caused to approach the target value orbit indicated by the solid line 201.

As a result of establishment of such a control system, the color misregistration by the lateral movement correction control in Embodiment 1 is shown in FIG. 15 by a solid line 203. In FIG. 15, also the color misregistration in the case where conventional lateral movement correction control using the single steering method effected by only the belt driving roller 34 on the basis of the output of the upstream edge sensor 38*a* is shown by a broken line 204.

As shown in FIG. 15, by the double steering method for controlling the conveyance direction of the intermediary transfer belt 31, a degree of the color misregistration is smaller than that by the conventional single steering method.

Embodiment 2

Parts (a) and (d) of FIG. 16 are illustrations of a steering constitution in Embodiment 2. FIG. 17 is an illustration of a structure of an intermediary transfer unit in Embodiment 2. In FIG. 17, constituent elements common to Embodiments 1 and 2 are represented by the same reference numerals or symbols and will be omitted from redundant description. In this embodiment, in place of the tilt steering method of E1 in which the steering roller is tilted, a shift steering method in which the steering roller is shifted and moved in an axial direction is employed.

As shown in FIG. 17, in this embodiment, the belt driving roller 34 is provided with the function of moving in Y direction (axial direction) and when the lateral movement is generated on the intermediary transfer belt 31, the belt driving roller 34 moves in the axial direction to quickly cancel the lateral movement.

As shown in (d) of FIG. 16, the belt driving roller 34 is rotatably mounted on a driving motor frame 65 movable in the Y direction relative to a belt frame 66 which is a structure constituting the intermediary transfer unit.

At an end of the driving motor frame 65, an eccentric cam 67 to which a driving force is supplied by a shift motor 64 is fixed on the belt frame 66, so that the driving motor frame 65 is always contacted to the eccentric cam 67 by an offset spring 68.

As shown in (b) of FIG. 16, when the eccentric cam 67 is rotated in the counterclockwise direction (CCW) by drive of the shift motor 64, the driving motor frame 65 moves to the rear side in the Y direction relative to the belt frame 66.

As shown in (c) of FIG. 16, when the eccentric cam 67 is rotated in the clockwise direction (CW), the driving motor frame 65 moves to the front side in the Y direction relative to the belt frame 66.

As a result, the belt driving roller 34 moves in the Y direction, so that the intermediary transfer belt 31 moves in the widthwise direction. Thus, the position of the intermediary transfer belt 31 with respect to the widthwise direction can be adjusted.

In the case where the belt member is controlled by tilting the steering roller, the tilting is fluctuated by slipping on the belt member and therefore a curve of the fluctuation in a transient state is smooth, so that response requires time. On the other hand, in the case where the steering roller is moved in the Y direction to displace the belt member, the belt member is directly displaced and therefore the response is quick. However, in the case where the steering roller is displaced in the Y direction, the movement amount is limited by the constitution of the apparatus.

For that reason, the control of the belt member only by using the Y direction movement method cannot be effected and therefore a combination of a correcting means for displacing the steering roller in the Y direction and a correcting means for controlling the belt member by tilting the steering roller is effective.

As shown in FIG. 3, in the case where the mechanical mechanism in this embodiment is employed in the belt driving roller 34, similarly as in Embodiment 1, the first controller 51 executes the control in which the belt driving roller 34 is moved in the Y direction on the basis of the detection signal from the upstream edge sensor 38*a*. By this operation, the intermediary transfer belt 31 is subjected to the lateral movement correction control (walk control) so that the belt position detected by the upstream edge sensor 38*a* is kept constant.

On the other hand, the second controller 52 effects, as described in Embodiment 1, the two-degree-of-freedom control in which the lateral movement amount follows the target value changed in real time by using the transfer function of FIG. 11.

Further, in this embodiment, the belt driving roller 34 is provided with the Y direction movement function but as a constitution for tilting the belt driving roller 34, the belt driving roller 34 may also be provided with the shift steering function similarly as in the case of the downstream steering roller 35.

Embodiment 3

FIG. 18 is an illustration of a structure of an intermediary transfer unit in Embodiment 3. In FIG. 18, constituent elements common to Embodiments 1 and 3 are represented by the same reference numerals or symbols and will be omitted from redundant description.

As shown in FIG. 18, in this embodiment, an idler roller 69 is provided downstream of the belt driving roller 34 and upstream of the transfer surface 53, and the follower roller 32 is provided upstream of the steering roller 35 and downstream of the transfer surface 53. As a result, the transfer surface 53 is supported by the idler roller 69 and the follower roller 52 which are not tilted.

Also in this embodiment, similarly as in Embodiment 1, the belt driving roller 34 has the steering function and as shown in FIG. 3, the control such that the position of the upstream edge sensor 38*a* disposed in the neighborhood of the belt driving roller 34 is kept constant is carried out by the first controller 51.

By the action of the idler roller 69 provided in this embodiment, in the case where the belt driving roller 34 is tilted, a fluctuation in height of the transfer surface 53 with respect to a Z direction can be eliminated.

Embodiment 4

FIG. 19 is an illustration of a structure of an image forming apparatus in Embodiment 4. In FIG. 19, constituent elements common to Embodiments 1 and 4 are represented by the same reference numerals or symbols and will be omitted from redundant description.

As shown in FIG. 19, in the image forming apparatus 20 in this embodiment, the steering roller 35 is provided upstream of the image forming portions 20Y, 20M, 20C and 20K, and the belt driving roller 34 having the Y direction movement function is provided downstream the image forming portions 20Y, 20M, 20C and 20K. That is, in Embodiments 1 and 2, the belt driving roller 34 is provided at the upstream side and the steering roller 35 is provided at the downstream side but the present invention is not limited thereto.

As shown in FIG. 19, even when the correcting means having the lateral movement correction control function is provided at both of the upstream side and the downstream side, by providing the plurality of sensors as described above to correct the lateral movement, it is possible to form the image free from the color misregistration.

Embodiment 5

In Embodiments 1 to 4, the image forming apparatus using the intermediary transfer belt was described. However, the present invention can be used also in recording material conveyer belt lateral movement correction control in the image forming apparatus using the recording material conveyer belt.

In this case, the first image bearing member transfers a first toner image onto the recording material carried on the recording material conveyer belt. Further, the second image bearing member transfers a second toner image onto the recording material on the recording material conveyer belt on which the first toner image is transferred.

Then, the image steering means subjects the belt member before entering the position of the first image bearing member, to the lateral movement correction control so that the toner image is transferred from the first image bearing member onto the recording material at a predetermined position with respect to the widthwise direction of the belt member.

However, other constitutions and control are the same as those as described in Embodiment 1.

<Comparison with Constitution of JP-A 2000-233843>

In JP-A 2000-233843, the belt edge sensors are provided at different positions with respect to the intermediary transfer belt movement direction, and the lateral movement position of the intermediary transfer belt with respect to the intermediary transfer belt widthwise direction is detected by the two belt edge sensors. Then, from the difference between the outputs of the two belt edge sensors, a slope (tilting) of the intermediary transfer belt with respect to the conveyance direction is obtained and then a tilting operation of one of the steering rollers is controlled so as to correct the slope of the intermediary transfer belt with respect to the conveyance direction.

However, in this constitution, the steering roller is a secondary transfer opposite roller provided at the secondary transfer portion where the toner image is transferred onto the recording material and therefore a change in attitude of the belt at the transfer surface on which the photosensitive drums are disposed cannot be corrected.

<Comparison with Constitution of JP-A 2006-076784>

In JP-A 2006-076784, the steering roller and the belt edge sensor are provided at each of the upstream side and downstream side of the transfer surface. Further, at the upstream side of the transfer surface, the steering roller is subjected to the tilting control so that the output of the belt edge sensor is kept constant. Also at the downstream side of the transfer surface, the steering roller is subjected to the tilting control so that the output of the belt edge sensor is kept constant.

However, when the conveyance direction is abruptly changed to align the downstream and upstream positions, the degree of color misregistration is decreased after the downstream and upstream positions are aligned but during the change of the conveyance direction, a large degree of the color misregistration is rather generated. Therefore, in order to suppress the color misregistration generated on the transfer surface of the intermediary transfer belt, as described in Embodiment 1, there is a need to use the control algorithm such that the conveyance direction is kept constant in real time as much as possible and the belt is not completely shifted (deviated).

That is, the upstream belt lateral movement correcting means with respect to the belt conveyance direction effects the normal lateral movement correction control in which the detection position by the upstream belt position detecting means is converged to a certain target value. Further, the downstream belt lateral movement correcting means effects the target value following control in which the target control value is changed in real time by using the difference between the detection positions by the downstream and upstream belt position detecting means.

As described above, according to the image forming apparatuses in Embodiments 1 to 4, even when the belt position fluctuation is generated at the upstream side, the conveyance direction of the belt can be kept constant by the downstream steering means. For this reason, the degree (amount) of the color misregistration can be alleviated compared with the case where the belt meandering control is carried out by a single steering operation.

Further, the positional control by the upstream belt lateral movement position detecting means is also effected and therefore the complete lateral movement of the belt can be prevented. As a result, it is possible to provide a medium conveying apparatus and image forming apparatus which are capable of realizing high-definition image formation.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 274210/2010 filed Dec. 9, 2010, which is hereby incorporated by reference.

What is claimed is:

1. An apparatus comprising:

a belt member;

a first image bearing member configured to bear a toner image to be transferred onto said belt member;

a second image bearing member, provided downstream of said first image bearing member with respect to a rotational direction of said belt member, configured to bear a toner image to be transferred onto said belt member;

a first steering roller, provided upstream of said first image bearing member with respect to the rotational direction of said belt member, configured to control a widthwise position of said belt member by inclining at a position;

a second steering roller, provided downstream of said second image bearing member with respect to the rotational direction of said belt member, configured to control the widthwise position of said belt member;

a first detecting member configured to detect a widthwise position of said belt member on said first image bearing member;

a second detecting member configured to detect a widthwise position of said belt member on said second image bearing member;

a first control portion configured to control an inclination of said first steering roller on the basis of a detection result of said first detecting member; and a second control portion configured to control said second steering roller based on a detection result of said first detecting member before a predetermined time and based on a current detection result of said second detecting member.

2. An apparatus according to claim 1, wherein said second control portion increases the amount of lateral movement generated with respect to said belt member, within a range not exceeding the amount of lateral movement of said belt member generated on said first image bearing member in the widthwise direction of said belt member, with continuation for a longer time of the movement of said belt member generated on said first image bearing member in the widthwise direction of said belt member.

3. An apparatus according to claim 1, wherein a response speed of said second steering roller to a change of an output of said second detecting member is higher than that of said first steering roller to a change of an output of said first detecting member.

4. An apparatus according to claim 1, wherein the predetermined time is a time required to move said belt member from a position of said first image bearing member to a position of said second image bearing member.

5. An apparatus according to claim 1, further comprising a storing portion configured to store a detection result of said first detecting member at every predetermined time interval, wherein said second control portion controls said second steering roller on the basis of an output from said storing portion and the current detection result of said second detecting member.

6. An apparatus according to claim 1, wherein said second control portion sets an amount of lateral movement of said belt generated on said second image bearing member at a larger value with a larger amount of lateral movement of said belt generated on said first image bearing member.

* * * * *